US007832463B2

(12) United States Patent
Bergmiller et al.

(10) Patent No.: US 7,832,463 B2
(45) Date of Patent: Nov. 16, 2010

(54) COLLECTING TANK FOR A MULTIPLE-ROW HEAT EXCHANGER

(75) Inventors: Jörg Bergmiller, Ostfildern (DE); Thomas Seeger, Leinfelden-Echterdingen (DE)

(73) Assignee: Behr Industry GmbH & Co. KG, Stuttgart (DE)

( * ) Notice: Subject to any disclaimer, the term of this patent is extended or adjusted under 35 U.S.C. 154(b) by 7 days.

(21) Appl. No.: 11/632,708

(22) PCT Filed: Jul. 25, 2005

(86) PCT No.: PCT/EP2005/008069

§ 371 (c)(1), (2), (4) Date: Jul. 19, 2007

(87) PCT Pub. No.: WO2006/010581

PCT Pub. Date: Feb. 2, 2006

(65) Prior Publication Data

US 2007/0277956 A1 Dec. 6, 2007

(30) Foreign Application Priority Data

Jul. 23, 2004 (DE) ..... 10 2004 036 022

(51) Int. Cl.
*F28F 9/02* (2006.01)

(52) U.S. Cl. ..... 165/149; 165/176

(58) Field of Classification Search ..... 165/70, 165/173, 175, 176, 174, 149; 285/331
See application file for complete search history.

(56) References Cited

U.S. PATENT DOCUMENTS

| | | | | |
|---|---|---|---|---|
| 4,485,867 | A | 12/1984 | Melnyk et al. | |
| 4,651,821 | A * | 3/1987 | Moranne | 165/175 |
| 6,749,015 | B2 | 6/2004 | Moreau | |

FOREIGN PATENT DOCUMENTS

| | | | |
|---|---|---|---|
| DE | 25 02 291 | | 7/1976 |
| DE | 28 12 210 | A1 | 10/1978 |
| DE | 33 03 681 | A1 | 8/1983 |
| DE | 33 41 361 | A1 | 8/1984 |
| DE | 34 40 489 | A1 | 5/1986 |
| DE | 91 11 412 | U1 | 12/1991 |
| DE | 40 41 671 | A1 | 6/1992 |
| DE | 42 43 495 | A1 | 6/1994 |
| DE | 197 19 261 | C2 | 11/1998 |
| DE | 102 50 441 | A1 | 5/2004 |
| DE | 699 10 533 | T2 | 6/2004 |
| EP | 1 450 123 | A1 | 8/2004 |
| EP | 1 548 385 | A2 | 6/2005 |
| GB | 1 471 734 | | 4/1977 |
| GB | 2 082 312 | A | 3/1982 |
| GB | 2 166 862 | A | 5/1986 |

* cited by examiner

*Primary Examiner*—Teresa J Walberg
(74) *Attorney, Agent, or Firm*—Foley & Lardner LLP

(57) ABSTRACT

A collecting tank for a heat exchanger pertaining to a motor vehicle cooling installation includes a tank element. The tank element includes at least two collecting regions for receiving fluid, the receiving regions being embodied together as a single component and being outwardly sealed by a sealing element, and a bottom for closing the collecting regions. A sealing arrangement is provided between the tank element and the bottom, between two adjacent collecting regions. The sealing arrangement includes exactly one sealing element which, in addition to sealing between the two collecting regions, is used to seal the arrangement towards the outside. The sealing element is preferably arranged in a plane in the collecting tank, especially in a continuous channel.

16 Claims, 15 Drawing Sheets

99

99

A
A
B
B
C
C
99
7
88

COLLECTING TANK FOR A MULTIPLE-ROW HEAT EXCHANGER

The invention relates to a collecting tank for a multiple-row heat exchanger according to the preamble of claim 1.

In order to prevent leakage, conventional collecting tanks for multiple-row coolers, in particular for motor vehicle cooling systems, comprising a tank element, which has at least two regions, referred to in the following as collecting regions, which are connected to one another in one piece and hold fluid, and comprising a substantially planar base which closes off said collecting regions, have a sealing element at the outside, which sealing element is in particular round or oval in cross section and is in particular placed in a seam and is compressed by a peripheral edge of the tank element. In addition, leakage problems between the individual adjacent collecting regions of the collecting tanks occur if sealing elements are not provided. Leakage is, however, undesired, in particular where different circuits, if appropriate operating with different media or at different temperatures, are arranged adjacent to one another in the collecting tank. In order to prevent leakage between the individual collecting regions of the collecting tanks, further sealing elements are provided. Such an arrangement is however relatively complex.

It is an object of the invention to provide an improved collecting tank for a multiple-row heat exchanger. Said improved collecting tank should preferably also be cost-effective to produce.

Said object is achieved by means of a collecting tank having the features of claim 1. Advantageous embodiments are the subject matter of the subclaims.

According to the invention, a collecting tank, in particular for a heat exchanger of a motor vehicle cooling system, having a tank element which comprises at least two collecting regions which are connected to one another in one piece, hold fluid and are outwardly sealed off by a sealing element, and having a base which closes off said collecting regions of the tank element, with a sealing element being provided, between two adjacent collecting regions, between the tank element and the base, which sealing element is formed in one piece with the sealing element which serves to provide outward sealing, so that the two sealing elements form a common, single-piece sealing element. Because only one sealing element is provided which serves to provide both internal sealing and also sealing with respect to the environment, the number of parts and therefore also the assembly costs are reduced. Such an embodiment of the seal can reliably prevent leakage between two adjacent collecting regions, in particular in the region between that part of the sealing element which serves to seal off two adjacent collecting regions and the region which serves to provide outward sealing.

It is preferable for a channel to be formed in the base, with the sealing element being inserted in said channel, and for a face which corresponds approximately to the width of the channel to be provided on the tank element, said face bearing at least partially against the sealing element, so that a sufficient compressive stress can be exerted on the sealing element without the latter being damaged. It is alternatively possible for a channel to be formed in the tank element, with the sealing element being inserted in said channel, and for a face which corresponds approximately to the width of the channel to be provided on the base, said face bearing at least partially against the sealing element. The face is preferably formed as a projection which extends in the longitudinal direction of the collecting tank in the direction of the base or of the tank element. If the sealing element is inserted in the channel, then it is arranged in a plane, that is to say the forces generated as the base is clamped to the tank element act substantially perpendicularly to said plane and transverse forces are avoided.

A flat seal and/or cord seal is preferably used as a sealing element. Seals of said type can be produced and installed in a cost-effective manner.

The sealing element preferably has a projecting region at at least one corner, preferably at all four corners or at least at two diagonally opposite corners, which projecting region is externally visible even in the assembled state. Said projecting region simplifies the positioning of the sealing element and permits a simple visual check as to whether or not a sealing element is installed.

A tensile stress generating means and/or a correspondingly acting compressive stress generating means is preferably provided, which tensile stress generating means and/or compressive stress generating means ensures that the sealing arrangement, preferably formed by a flat seal or cord seal, which is arranged between the tank element and the base is sufficiently pressed in between the tank element and the base and therefore fulfills its function, that is to say reliably prevents leakage from one collecting region into the adjacent collecting region, even at high pressures.

The tensile stress generating means or the compressive stress generating means is preferably formed in at least two parts, preferably in three parts, and preferably comprises at least one threaded connection for adjusting the applied tensile stress or a clip-type connection for a simple and fast connection between the base and the tank element.

According to one embodiment, a part of the tensile stress generating means can be fixedly connected to the base or to the tank element, and can extend through the tank element or through the base in the region of an opening, said part having a thread at least in one part of the outwardly protruding region, with an element, in particular a nut, which is provided with a thread which interacts with said thread, being screwed onto said thread from the outside as a second part of the tensile stress generating means. Here, to simplify production, that part of the tensile stress generating means which is fixedly connected to the base or to the tank element is formed as a strip and has a plurality of openings in which screws or threaded bolts can be fastened so as to be rotationally fixed.

According to an alternative embodiment, a part, which has an inner thread, of the tensile stress generating means can be fixedly connected to the base or to the tank element, and the tank element or the base has an opening through which an element which has an outer thread extends, said element being screwed into the inner thread. In this case as well, that part of the tensile stress generating means which is fixedly connected to the base or to the tank element is formed as a strip and has a plurality of openings having an inner thread.

The tensile stress generating means which, in a corresponding embodiment, can also be arranged in an edge region of a collecting region, has at least one sealing element for the purpose of providing sealing with respect to the environment.

In the case of an embodiment of the tensile stress generating means as a clip-type connection, preferably as a plurality of clip-type connections arranged in a row, on the tank element or on the base at least one resilient arm is preferably formed or provided on, in particular injection-molded into, the part which engages into an opening in the base or in the tank element. This allows simple and very fast assembly. The plurality of openings are preferably each circular or slot-shaped.

If the tensile stress generating means or the compressive stress generating means is arranged centrally between two collecting regions, one sealing arrangement is preferably provided at each side of said means.

The collecting tank is preferably used in a heat exchanger, in particular cooler, of a motor vehicle cooling system.

It is self-evident that the invention relates not only to plastic collecting tanks but also to collecting tanks made from other materials, such as in particular aluminum. Through the provision of a tensile stress generating means or compressive stress generating means according to the invention, it is possible for plastic or metal collecting tanks to be formed, for example, with a slightly reduced wall thickness, or for relatively high pressures to be used. In this case, it is also possible in particular for a soldered or if appropriate welded connection to be provided instead of a connection by means of adhesive. The selected connection is dependent on the materials to be connected, the expected loads, in particular the expected temperatures and stresses, and the costs for the connection.

The invention is explained in detail in the following on the basis of exemplary embodiments and with reference to the drawing, in which:

FIG. 1 shows a section transversely through a collecting tank according to the first exemplary embodiment, FIG. 2 shows a section transversely through a collecting tank according to the second exemplary embodiment, FIG. 3 shows a section transversely through a collecting tank according to the third exemplary embodiment, FIG. 4 shows a section transversely through a collecting tank according to the fourth exemplary embodiment, FIG. 5 shows a section transversely through a collecting tank according to the fifth exemplary embodiment, FIG. 6*a* shows a section transversely through a collecting tank according to the sixth exemplary embodiment, FIG. 6*b* shows a plan view of part of the base of the collecting tank from FIG. 6*a,*

FIG. 7*a* shows a section transversely through a collecting tank according to the seventh exemplary embodiment, FIG. 7*b* shows a plan view of part of the base of the collecting tank from FIG. 7*a,*

Figure 12:
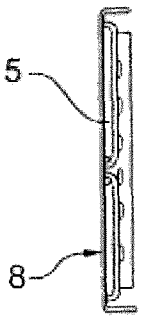
Figure 11:
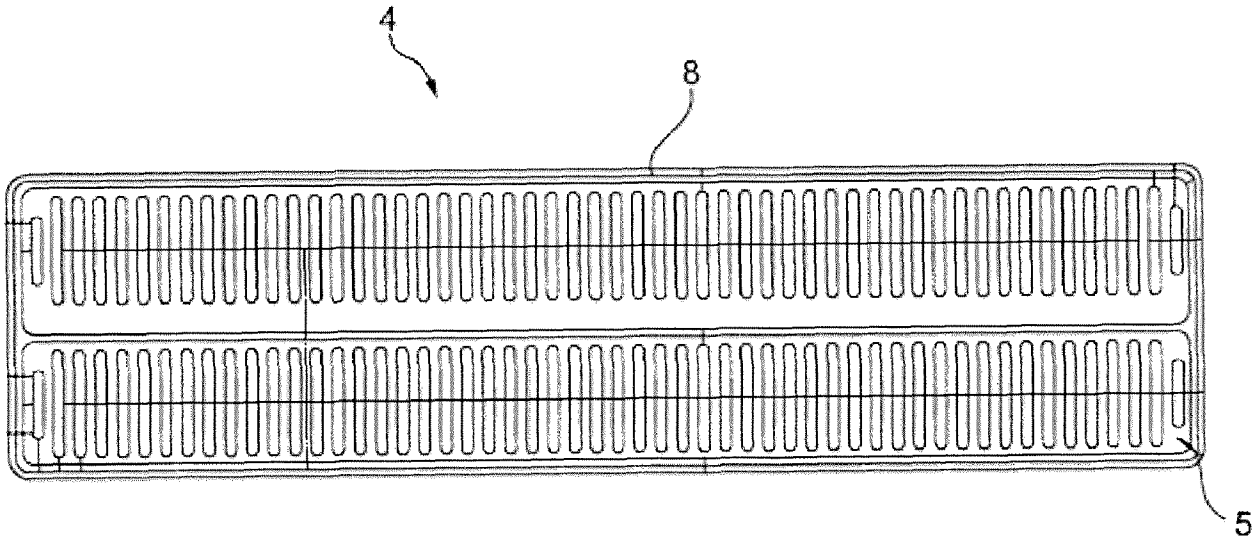
Figure 13:
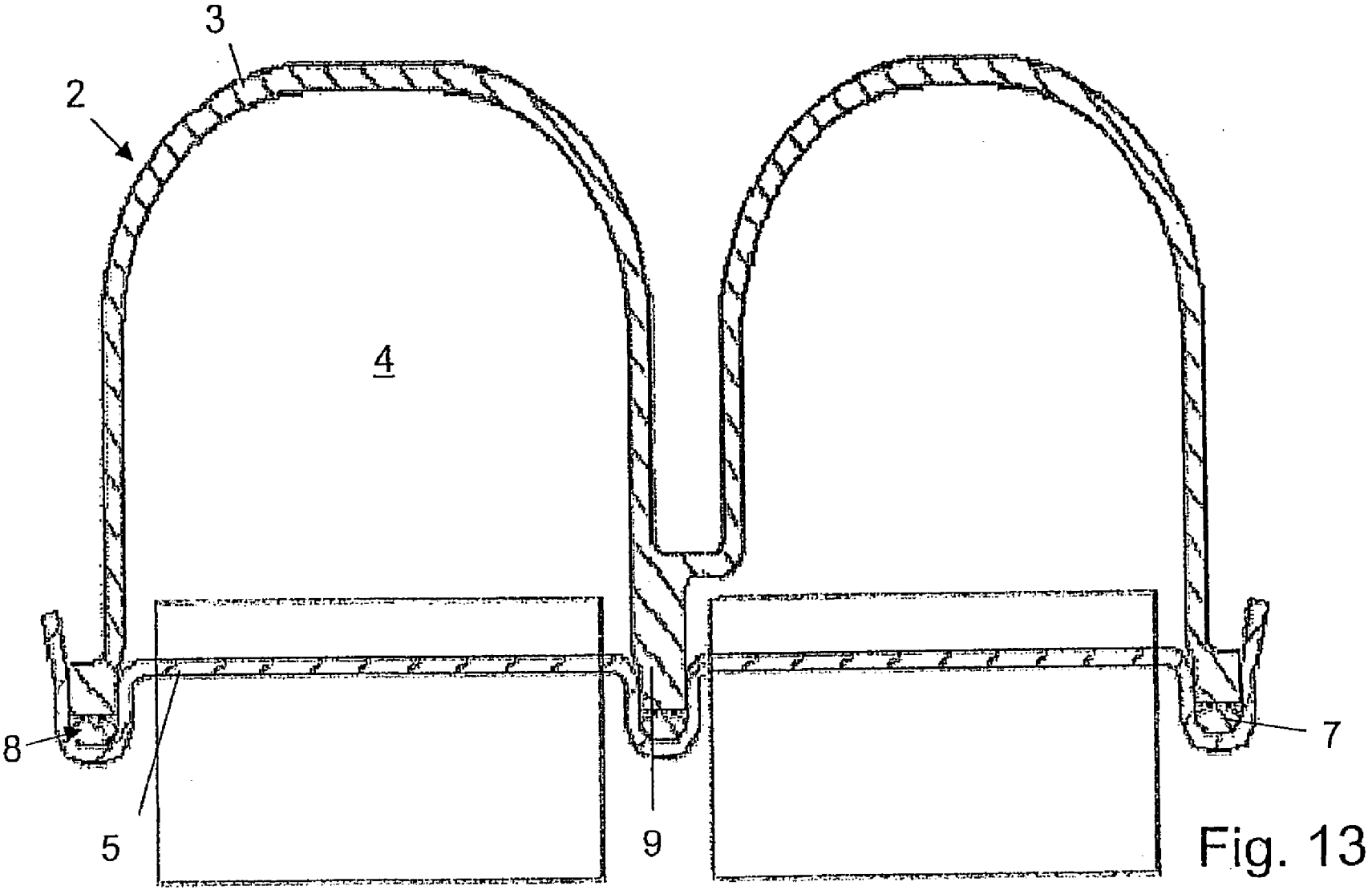
Figure 14:
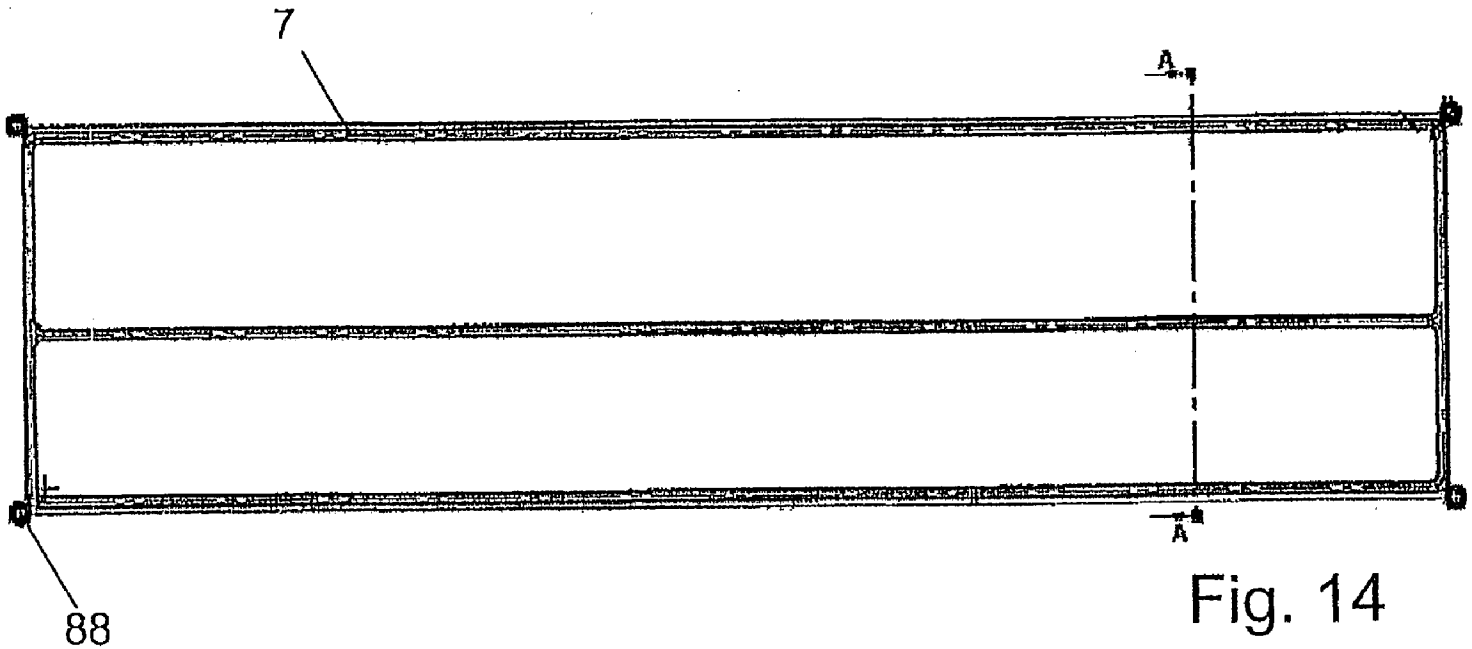
Figure 15:
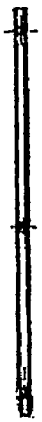
Figure 16:
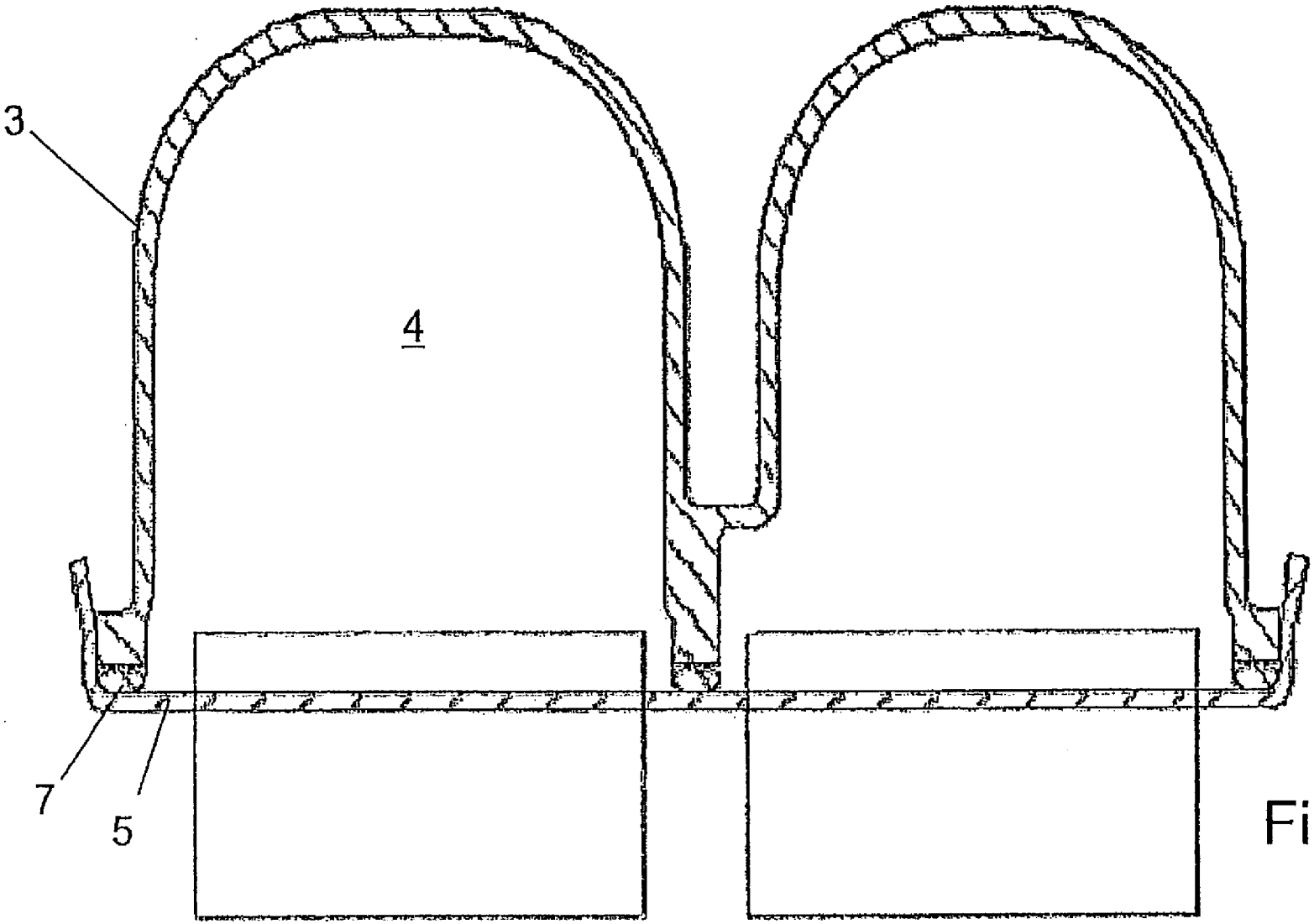
Figures 17, 18, 19, 20:
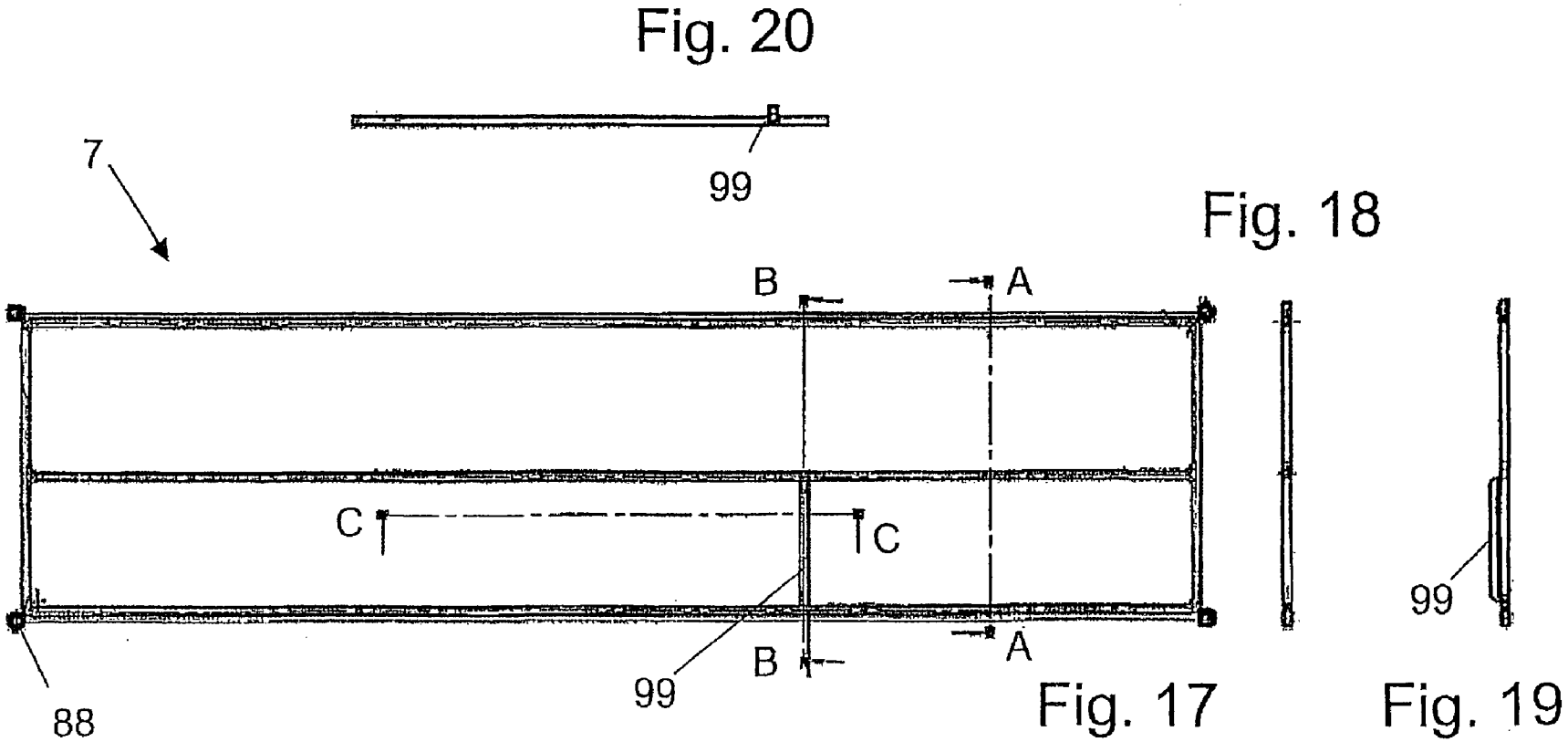

FIG. 11 shows a plan view of a base as is used in the eighth exemplary embodiment, FIG. 12 shows a section through the base of FIG. 11, FIG. 13 shows a section transversely through a collecting tank according to the eighth exemplary embodiment, FIG. 14 shows a plan view of the sealing element according to the eighth exemplary embodiment, FIG. 15 shows a section through the sealing element of FIG. 14, FIG. 16 shows a section transversely through a collecting tank according to the ninth exemplary embodiment, with a deflection being provided, FIG. 17 shows a plan view of the sealing element according to the ninth exemplary embodiment, FIG. 18 shows a section along the line A-A through the sealing element of FIG. 17, FIG. 19 shows a section along the line B-B through the sealing element of FIG. 17, and FIG. 20 shows a section along the line C-C through the sealing element of FIG. 17.

Figure 10:
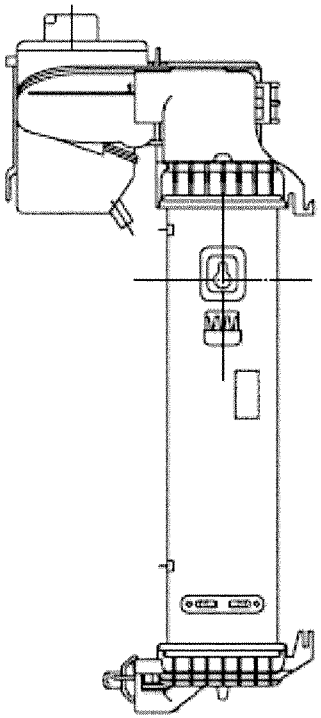
FIG. 10 shows a plan view of the cooler from FIG. 8.
Figure 9:
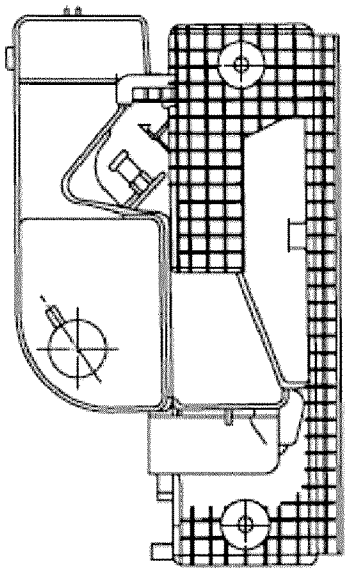
FIG. 9 shows a side view of the cooler from FIG. 8.
Figure 8:
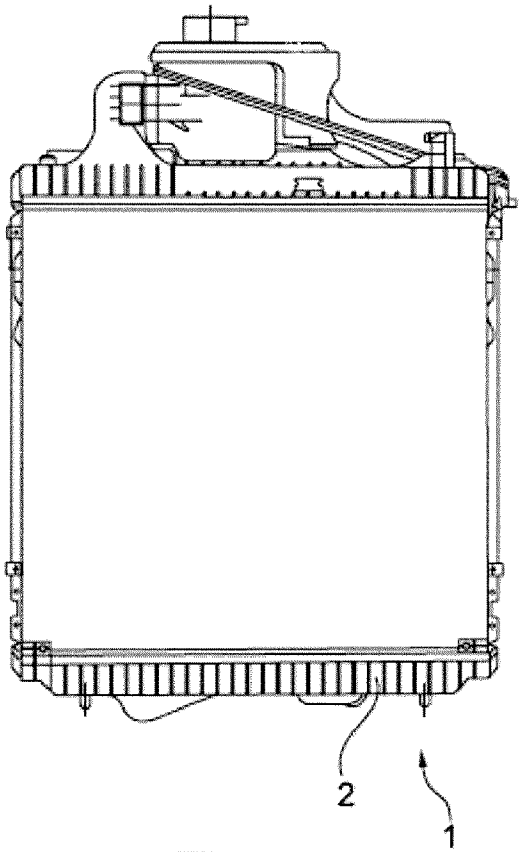
FIG. 8 shows a view of a cooler having two collecting tanks.

A motor vehicle cooling system has, as a heat exchanger 1, a two-row cooler having two laterally arranged collecting tanks 2 and having flat tubes (illustrated schematically in the drawing by rectangles) and corrugated fins which run in between said collecting tanks 2, as illustrated in FIGS. 8 to 10. Here, the individual rows of the heat exchanger 1 are part of different circuits, so that the media located in said circuits differ at least in terms of their operating states, for which reason it must be ensured that no leakage takes place between the circuits in the collecting tanks 2.

Each collecting tank 2 is composed of a tank element 3 having two collecting regions 4, which are formed in one piece with one another and hold in each case one medium, and having a substantially planar base 5 which closes off said collecting regions 4. A plurality of openings are formed in two rows in the base 5, said openings substantially corresponding in cross section to the cross section of the flat tubes, which protrude through said openings slightly into the collecting region 4.

To prevent leakage of the collecting regions 4 to the outside, that is to say to the environment, the outer edges of the base 5 are formed corresponding to the drawing in a way known per se, with a slightly elastic sealing element being arranged between the thickened ends of the tank element 3 and the channel-like outer edges of the base 5.

To prevent leakage between the individual collecting regions 4, a sealing arrangement 6 is provided in each collecting tank 2, said sealing arrangement 6 being arranged between the tank element 3 and the base 5 between the collecting regions 4. The sealing arrangement 6 has a slightly elastic sealing element 7' which is compressed by the tank element 3 and the base 5. Here, said sealing element for providing sealing with respect to the environment and the sealing element 7' for providing sealing between the collecting regions 4 are formed in one piece, in a form as illustrated for example in FIG. 14, and are denoted in their entirety by the reference symbol 7.

Since there is the risk, in particular when there are high pressures in the collecting regions 4, of the collecting tank 2 being deformed as a result of the high internal pressure, the following measures are implemented to ensure the sealing action between the two collecting regions 4:

Firstly, a channel 8 which runs in the longitudinal direction of the sealing arrangement 6 is provided in the substantially plate-shaped base 5, with the sealing element 7 being inserted in said channel 8. Here, the channel 8 has the same depth as the channel-like outer edge of the base 5, so that, in the installed state, the sealing element 7 is arranged so as to be planar over its entire length.

The tank element 3 has a projection 9 which extends in the longitudinal direction of said tank element 3 and has an outwardly-directed face which fits at least into the outer region of the channel 8. The projection 9 projects into the channel 8 to the same extent as the outer thickened ends of the tank element 3. As a result of the tensile stresses which normally prevail as a result of the fastening of the base 5 to the tank element 3, the sealing element 7 is subject over its entire length to a compressive stress which is sufficient for most situations.

Secondly, to increase the reliability, a tensile stress generating means 10 is provided adjacent to the sealing arrangement 6; said tensile stress generating means 10 is to be explained in more detail in the following with reference to the individual exemplary embodiments and the associated figures of the drawing. Since the design principle of the collecting tank 2, as described previously, remains unchanged, the reference symbols stated previously are used for all the exemplary embodiments.

Figure 1:
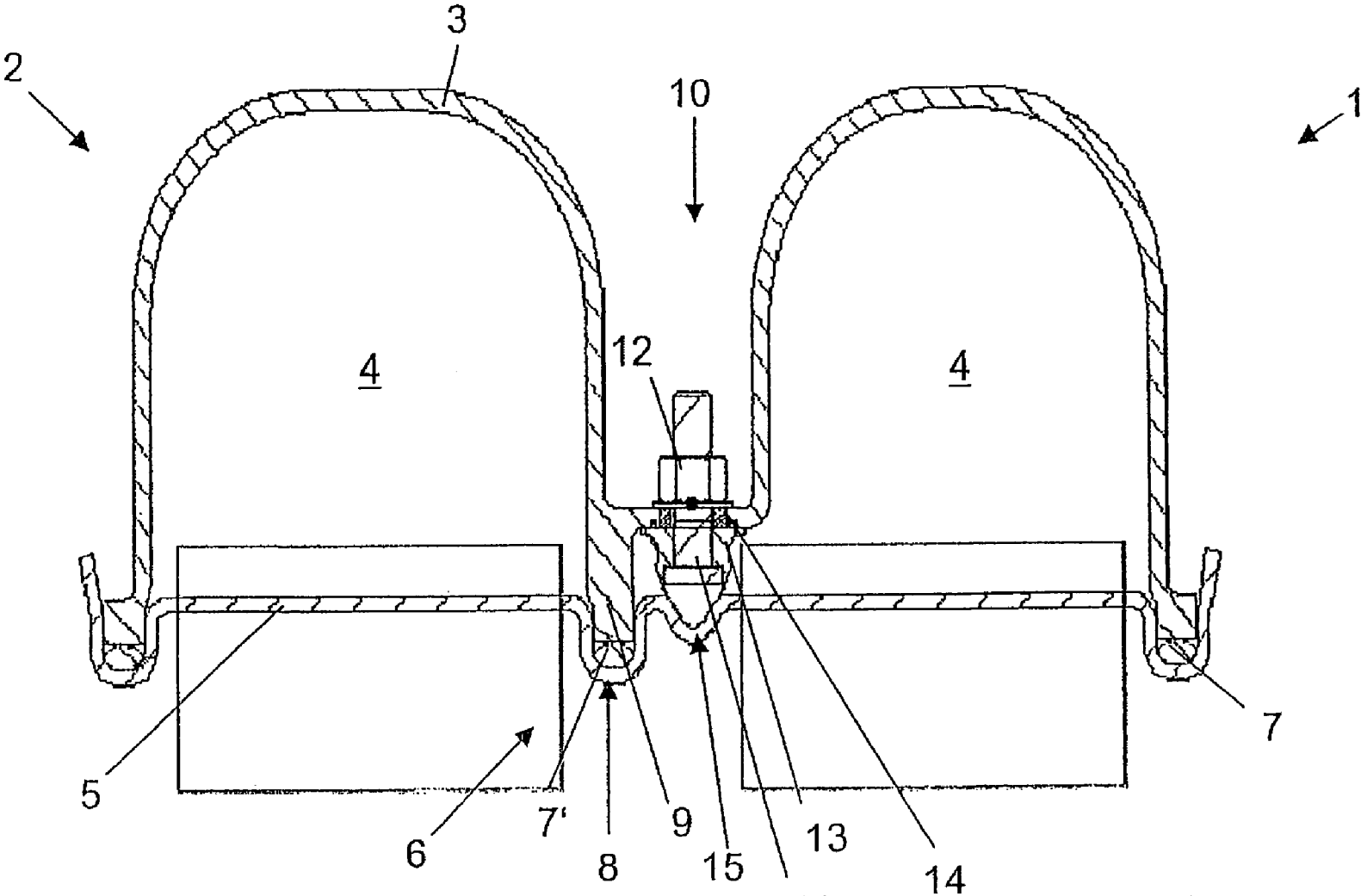

FIG. 1 shows a first exemplary embodiment, which relates to a plastic collecting tank 2, in which the tensile stress generating means 10 has a plurality of screws 11 and nuts 12, which interact with said screws 11, arranged in a row. The heads of the screws 11, together with an element 13, which extends in the longitudinal direction parallel to the channel 8 with the screws 11 being inserted into and being rotationally fixedly connected, in the first exemplary embodiment adhered, to said element 13, are fixedly adhered to the base 5 of the collecting tank 2, with the end regions of said screws 11 protruding through openings in the tank element 3. The nuts 12 are arranged on that side of the tank element 3 which faces away from the base 5. In addition, a sealing element 14 is arranged on each screw 11 at that side of the tank element 3 which faces the base, said sealing element 14 projecting into the region of the opening. In addition to providing positioning and additional support of the screws 11, the element 13 also serves as a plane bearing face for the sealing element 14, so that the latter is correctly positioned during installation and is uniformly loaded during operation.

In the region in which the heads of the screws 11 are connected to the base 5, the base 5 has a second channel 15 which runs parallel to the channel 8. Said second channel 15 ensures a good connection which is durable under varying pressures and the associated elastic deformations of the collecting tank 2. In its region between the two collecting regions 4, at least as viewed from the side facing away from the base 5, the tank element 3 is formed so as to be planar and sufficiently wide that the nut 12 can be easily tightened to the required torque. As a result of the nuts 12 of the tensile stress generating means 10 being tightened, the tank element 3 is moved, in its central region and over its entire length, towards the base 5, and is clamped to the latter. The preload acts on the adjacently-running sealing arrangement 6 such that the sealing element 7 is compressed to a greater degree between the tank element 3 and the base 5.

Figure 2:
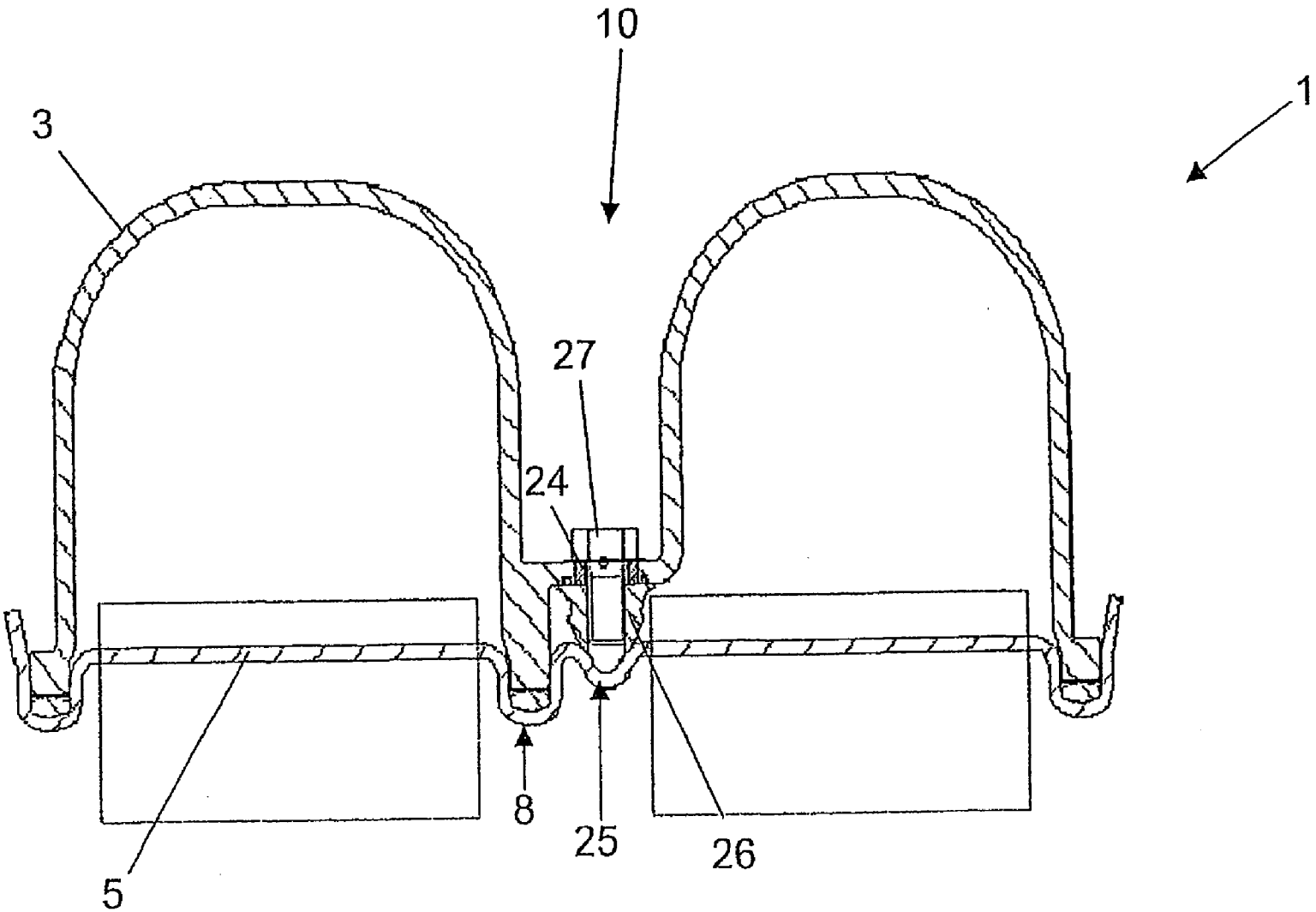

In the second exemplary embodiment illustrated in FIG. 2, the geometric dimensions of the tank element 3 and of the base 5 correspond to those of the first exemplary embodiment, with a second channel 25 in turn being provided, said second channel 25 being formed in the base 5 and extending parallel to the first channel 8. However, in the tensile stress generating means 10 of the second exemplary embodiment, an element 26 which is provided with a plurality of inner threads is adhered in the region of the second channel 25, with screws 27 being screwed into said element 26 through openings in the tank element 3 so that the same function is performed as in the first exemplary embodiment. To provide sealing, sealing elements 24 are in turn provided, said sealing elements 24 corresponding in function to those of the first exemplary embodiment.

Figure 3:
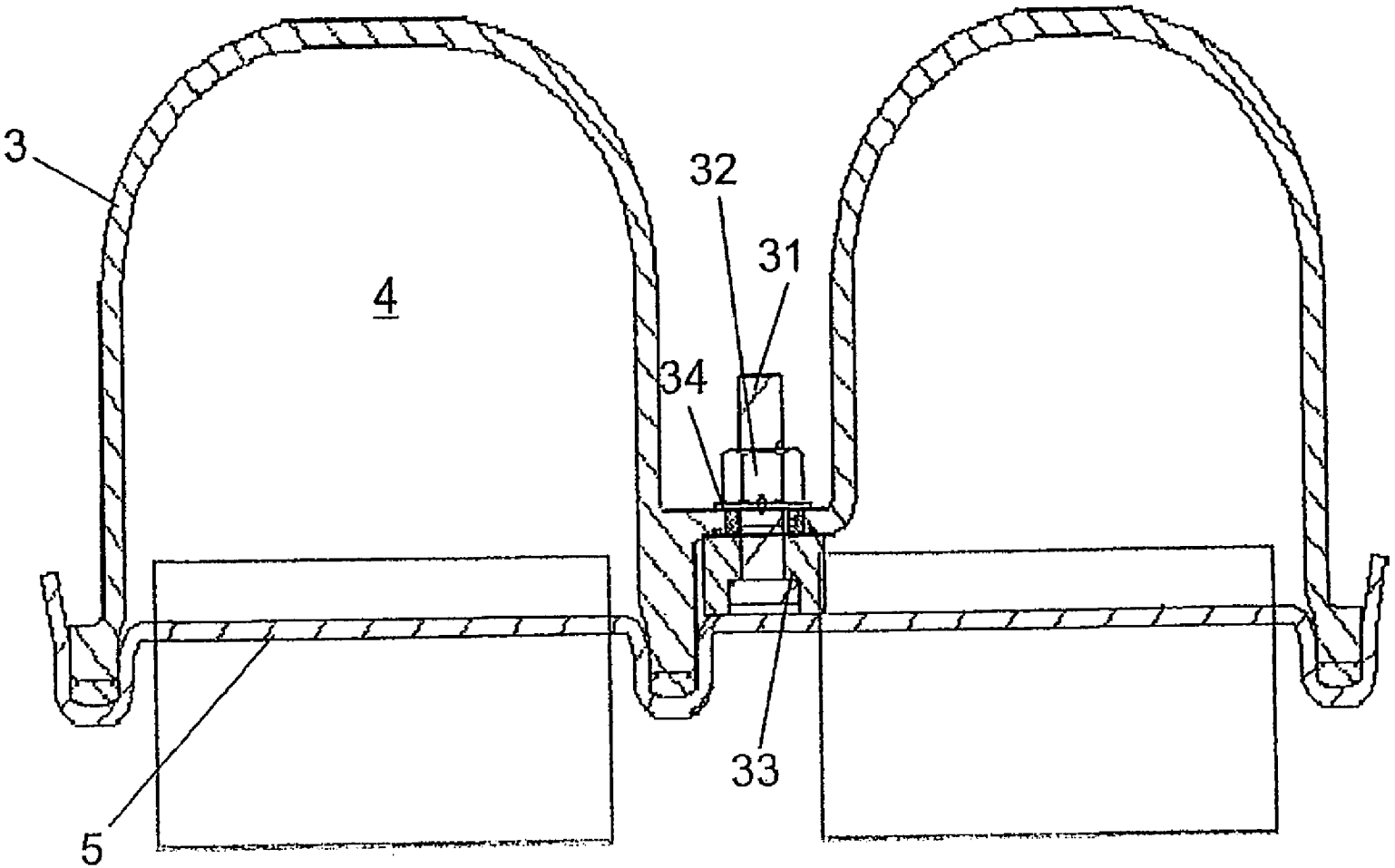

In the third exemplary embodiment illustrated in FIG. 3, the geometry of the tank element 3 corresponds to that of the tank element 3 of the first and second exemplary embodiments. However, no second channel is provided in the base 5, so that the latter runs in a substantially planar fashion up to the channel 8, and in principle forms a part of one of the collecting regions 4. An element 33 which extends in the longitudinal direction parallel to the channel 8 is adhered, as in the first exemplary embodiment, to that side of the base 5 which faces the tank, said element 33 comprising a plurality of screws 31 which are inserted through openings in the element 33 and are adhered to the tank element 3. Nuts 32 are screwed onto those ends of the screws 31 which protrude through openings in the tank element 3. Sealing elements 34 are likewise provided, as in the previously described exemplary embodiments, for sealing off the openings.

Figure 4:
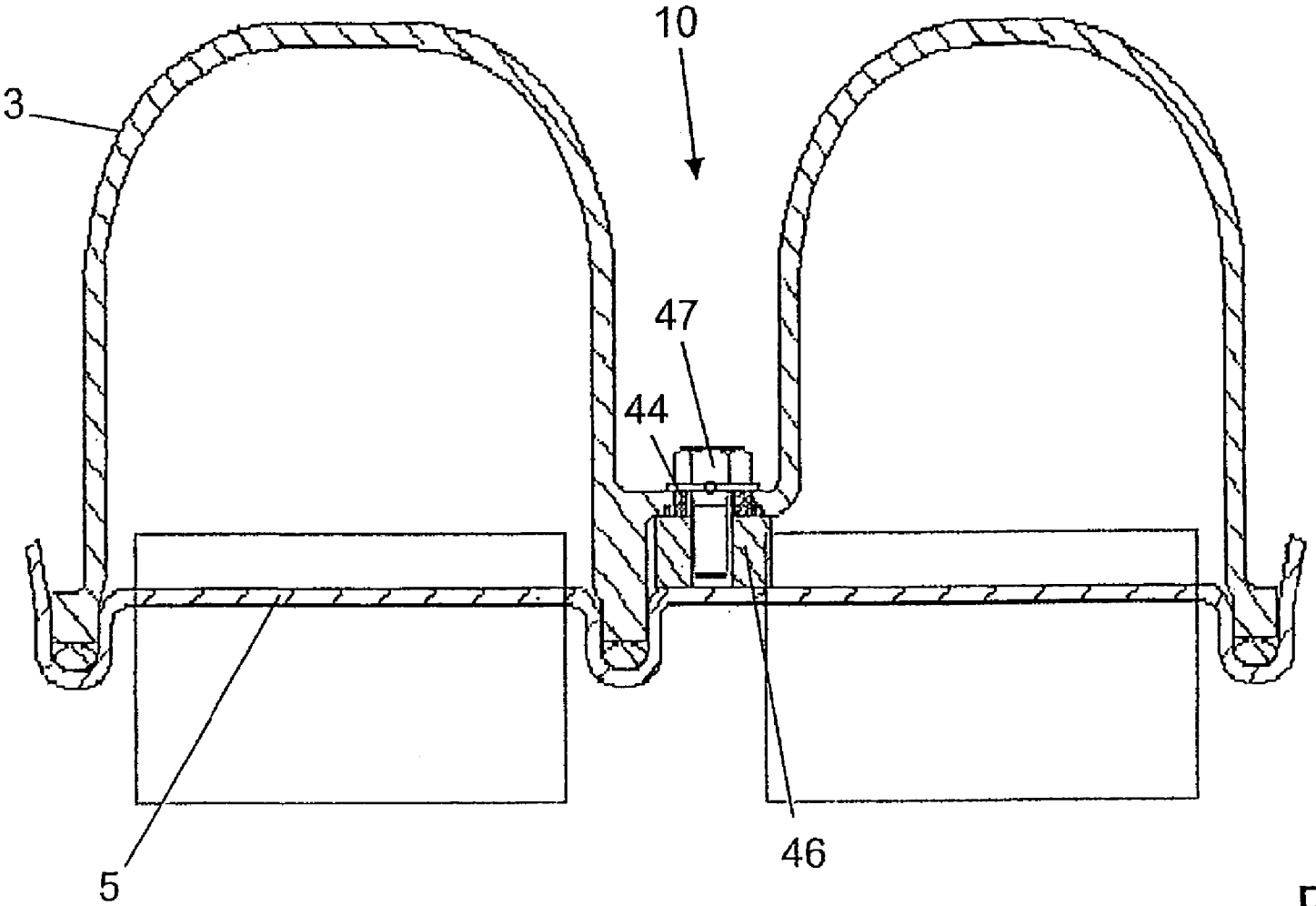

FIG. 4 shows the fourth exemplary embodiment which corresponds in principle to a combination of the geometry of the third exemplary embodiment with the tensile stress generating means 10 of the second exemplary embodiment. As a result of the second channel being dispensed with, the element 46 which is provided with a plurality of inner threads is formed as a strip, and is adhered by means of one face to that plane face of the base 5 which faces the tank. Screws 47 which are inserted through openings in the tank element 3 are screwed into the element 46. Sealing elements 44 for sealing off the openings are also provided.

Figure 5:
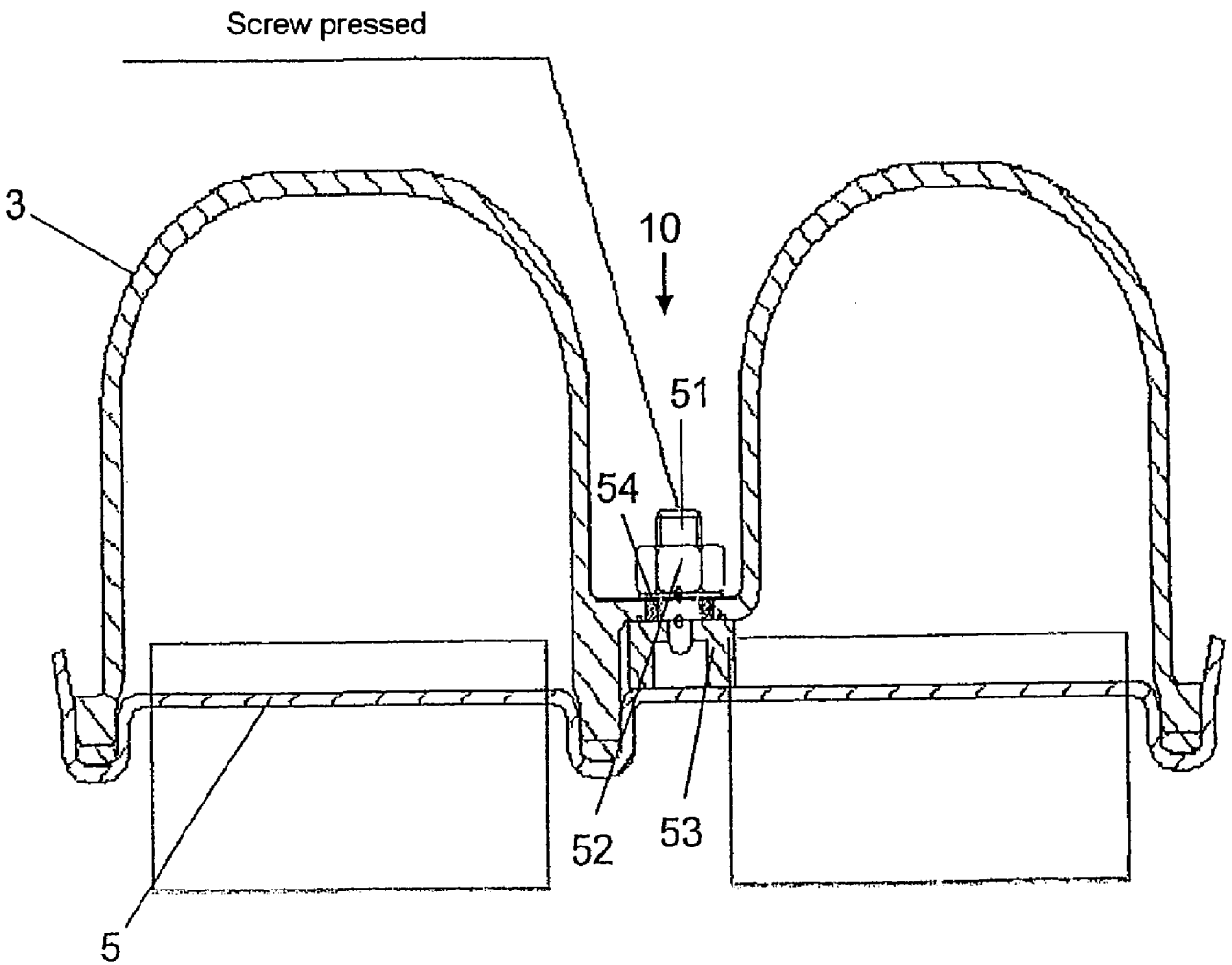
Figure 6A:
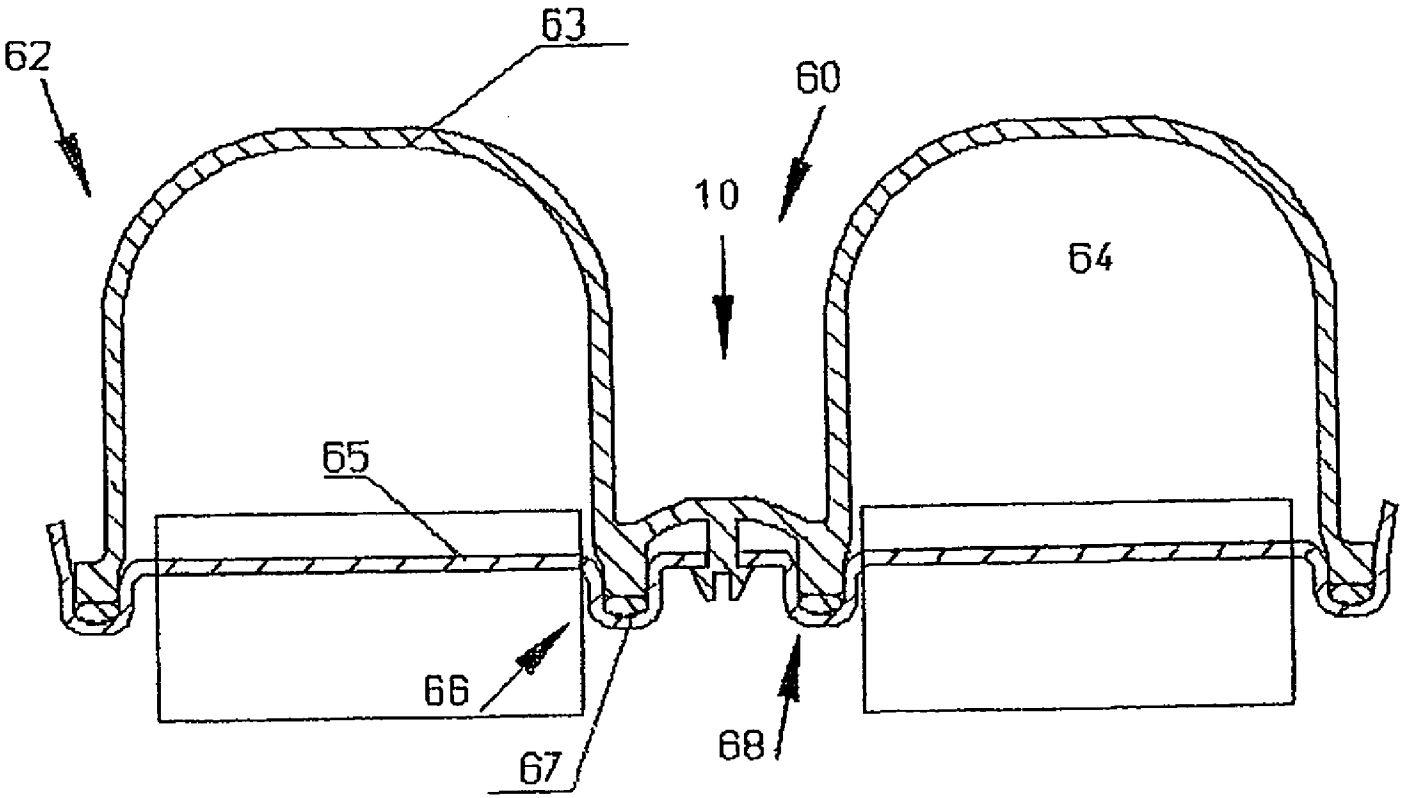
Figure 6B:
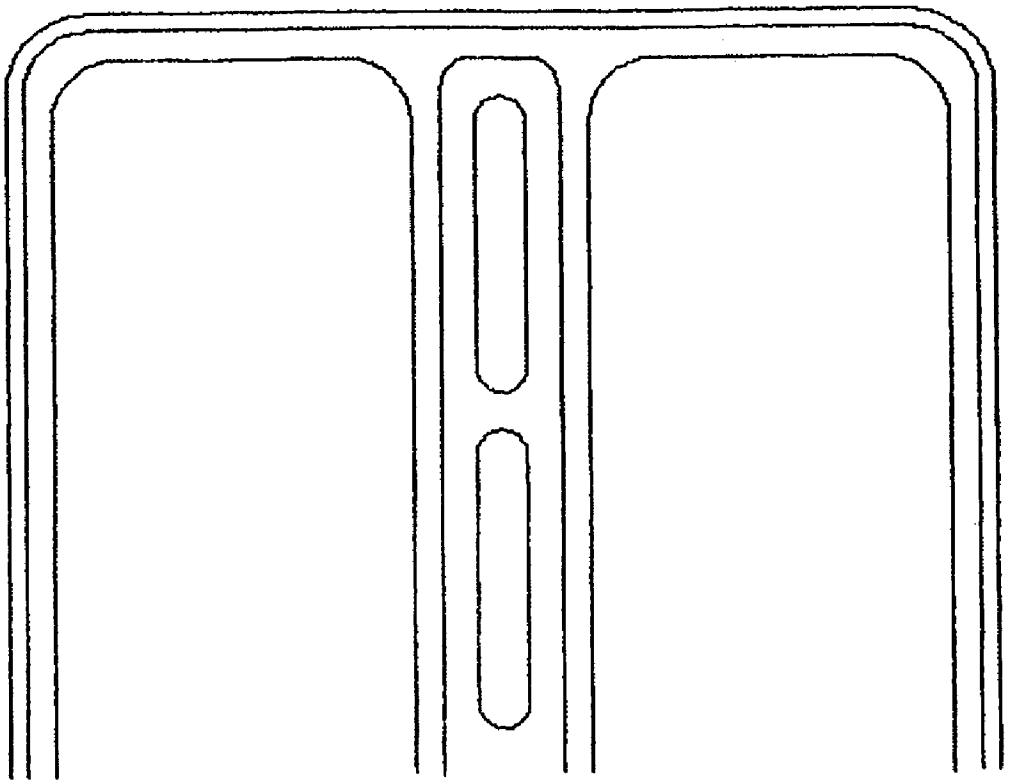
Figure 7A:
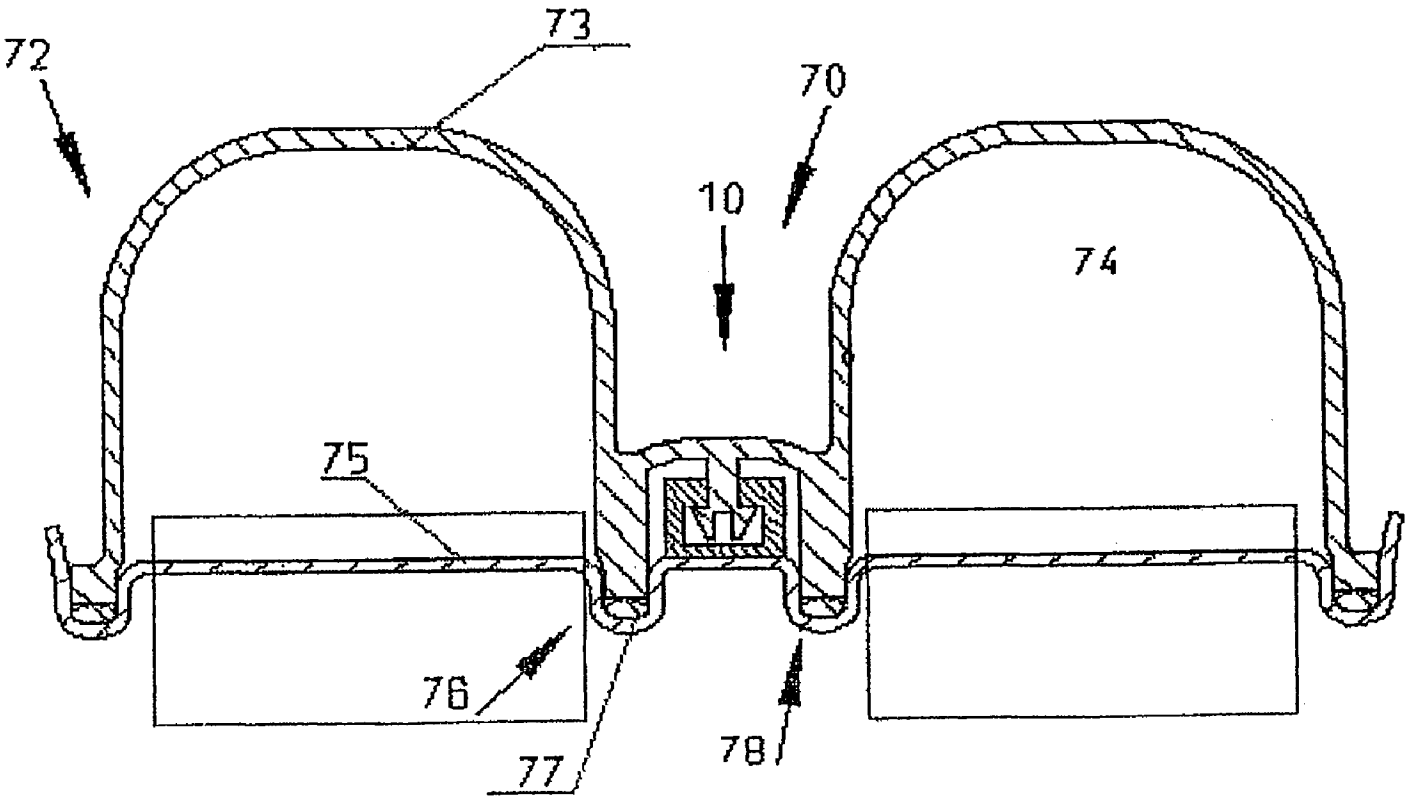
Figure 7B:
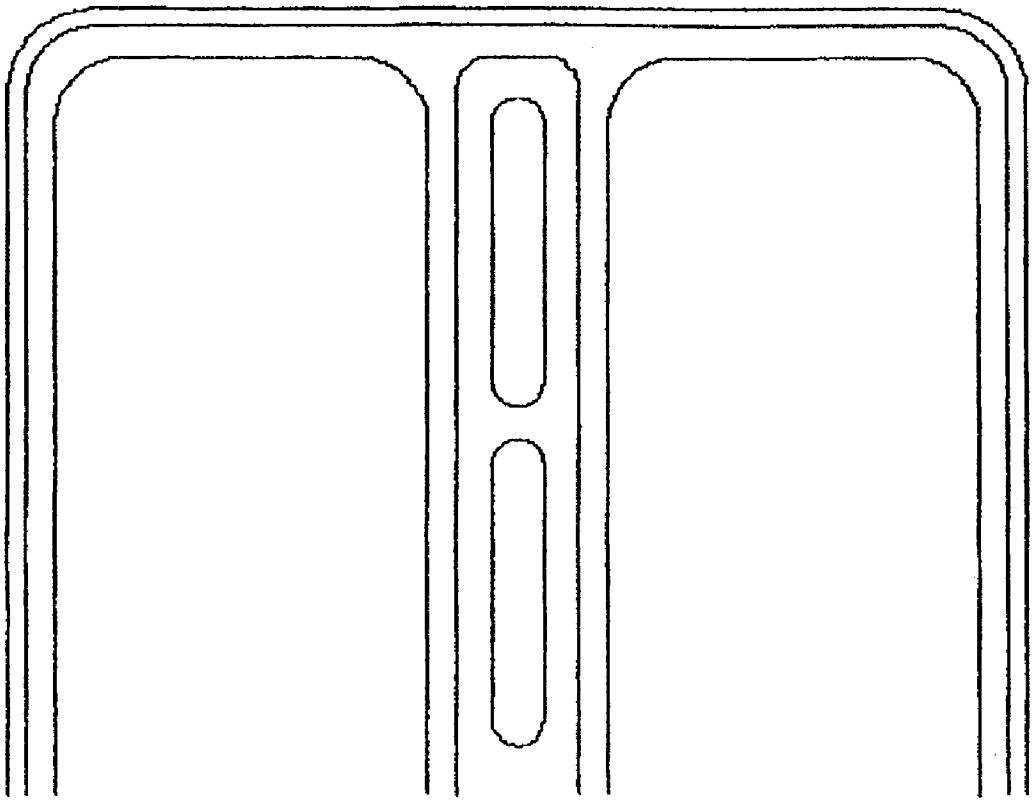

In the fifth exemplary embodiment, illustrated in FIG. 5, the geometry of the tank element 3 and of the base 5 corresponds to the previously described third exemplary embodiment. A U-shaped element 53 which extends in the longitudinal direction parallel to the channel 8 is adhered, as in the third exemplary embodiment, to that side of the base 5 which faces the tank, said element 53 comprising a plurality of threaded bolts 51 which, with one end, are inserted through openings into the element 53 and are pressed into the element 53. Nuts 52 are screwed onto those ends of the threaded bolts 51 which protrude through openings in the tank element 3. Sealing elements 54 are likewise provided, as in the previously described exemplary embodiments, for sealing off the openings.

FIGS. 6*a*, 6*b*, 7*a*, 7*b* show a sixth and a seventh exemplary embodiment of a collecting tank 62 and 72 respectively, said collecting tank in each case differing in design from the previously described design substantially in that, instead of just one sealing arrangement 6, one sealing arrangement 66 and 76 respectively is arranged at each side of the tensile stress generating means, for which reason the tensile stress generating means 10 is arranged centrally between two collecting regions 64 and 74 respectively, and in that a row of clip-type connections 60 and 70 respectively are used instead of screws or threaded bolts as part of the tensile stress generating means 10, though the use of screws and the like is also possible.

For the sealing arrangements 66 and 76 respectively, in each case two channels 68 and 78 respectively, which run parallel to one another, are provided in the base 65 and 75 respectively, with in each case one sealing element 67 and 77 respectively being placed in said channels 68 and 78 respectively, said sealing element bearing at its other side against a plane face of the tank element 63 and 73 respectively.

In the sixth exemplary embodiment, each clip-type connection 60 is formed by a part which is injection molded into the tank element 63, said part having two spring arms with hook-shaped ends, and an undercut which interacts with said spring arms, said undercut being formed in the base 65 in the form of a plurality of openings formed as slots. Since a certain pressure is exerted during assembly to snap in the clip-type connection 60, the base 65 is pulled in the direction of the tank element 63 at all times, so that sufficient compression of the two parts is ensured in the region of the sealing arrangements 66.

In the seventh exemplary embodiment, the part having the spring arms is formed in one piece with the tank element 73, and corresponds in terms of its shape and mode of operation to that of the sixth exemplary embodiment. In contrast to the sixth exemplary embodiment, a hollow profile which is formed separately from the base 75 is attached to the base 75, with openings in the form of slots in the direction of the tank element 73 being formed in said hollow profile. The hook-shaped ends of the spring arms engage in said openings, and ensure a sufficient preload.

It is obvious that compressive stress generating means, which act correspondingly on the two outer sides of the tank element and the base, can also be provided instead of tensile stress generating means, for which purpose openings which are aligned with one another are provided in particular both in the tank element and in the base, with the compressive stress generating means, for example a screw with a nut, protruding through said openings, with the head of the screw bearing against one outer side and the nut bearing against the other outer side. Both stress generating means can also be combined with one another if appropriate.

It is likewise self-evident that, in all of the previously described exemplary embodiments, the arrangement of the openings and of the elements can be exchanged, that is to say the openings can be provided in the base and the elements can be attached to the tank element.

As is illustrated in the exemplary embodiments eight and nine, it is possible to dispense with a tensile stress generating means 10 or compressive stress generating means between the individual collecting regions 4, and the base 5 can be clamped to the tank element 3 in a way known per se.

FIGS. 11 and 12 show a base 5 for a two-row collecting tank which has, arranged in two rows, a plurality of slots, which are arranged in each case one planar region and run parallel to one another, for inserting flat tubes as indicated in FIG. 13 as rectangles. In addition, an 8-shaped channel 8 of constant depth relative to the two planar regions of the base 5 is provided, which channel 8 peripherally surrounds the two planar regions at the outside and separates said planar regions from one another by means of its transverse part. Cut-outs (not illustrated in any more detail) are provided in the four outer corner regions, the function of which cut-outs will be explained in more detail at a later point, but which cut-outs do not adversely affect the sealing function of an 8-shaped sealing element 7 which is inserted in the channel 8.

The tank element 3 is designed correspondingly to the tank element 3 illustrated in FIG. 3, but without the tensile stress generating means 10, so that the central region is of slightly narrower design (cf. FIG. 13). The tank element 3 has two collecting regions 4 which are formed in one piece with one another and hold in each case one medium.

Said tank element 3 also has, in its central region, a projection 9 which extends in the longitudinal direction of said tank element 3 and has an outwardly-directed face which fits at least into the outer region of the central region of the channel 8. The projection 9 projects into the channel 8 to the same extent as the outer thickened ends of the tank element 3. The projection 9 correspondingly also runs along the ends of all four outer sides, with the narrow sides not being illustrated but substantially corresponding in shape to that of the sides illustrated at the right and left of FIG. 13. As a result of the tensile stresses which normally prevail as a result of the fastening of the base 5 to the tank element 3, the sealing element 7 is subject to a compressive stress over its entire length which is sufficient for most situations.

The 8-shaped sealing element 7 (cf. FIG. 14) has a substantially circular cross section. Here, in each case one projecting region 88 is formed in one piece with the sealing element 7 at the outer corners, which projecting region 88, in the installed state, projects outwards through the cut-outs in the base 5, so that the installation and correct positioning of the sealing element 7 in the collecting tank 2 is readily apparent. In addition, the regions 88 facilitate positioning for assembly.

In the ninth exemplary embodiment illustrated in FIGS. 16 to 20, there is likewise no tensile stress generating means 10 or compressive stress generating means provided between the individual collecting regions 4. The channel 8 is also dispensed with, so that the sealing element bears evenly directly against the planar base 5, and is retained by the widened ends of the tank element 3.

The embodiment of the tank element 3 corresponds to that of the eighth exemplary embodiment, but with a separating wall (not illustrated) which runs transversely, that is to say in the direction of the section plane of FIG. 16, being provided in one of the two collecting regions 4.

According to the ninth exemplary embodiment, there is an additional division of one of the two collecting tanks 4, for which reason the sealing element 7, which has a substantially circular cross section corresponding to the previous exemplary embodiment, has a corresponding transverse connection 99 which, however, in the present case is formed higher as a result of the dimensions of the separating wall (cf. FIG. 17), so that said sealing element 7 not only seals off the two collecting tanks 4 outwardly and with respect to one another, but also seals off the divided collecting tanks 4 with respect to one another.

The invention claimed is:

1. A collecting tank, for a heat exchanger of a motor vehicle cooling system, comprising:

a tank element, the tank element comprising:

at least two collecting regions which are connected to one another in one piece, wherein the tank element is configured to hold fluid;

a sealing element; and a base, wherein the sealing element closes off said collecting regions of the tank element to outwardly seal the at least two collecting regions of the tank, wherein the sealing element is positioned around and spaced apart from a fastener region and at least a portion of the sealing element is spaced apart from another part of the sealing element is provided between two adjacent collecting regions and between the tank element and the base, wherein the sealing element seals off adjacent collecting regions from one another and is a single-piece sealing element, and wherein the sealing element is arranged in a plane of the collecting tank.

2. The collecting tank as claimed in claim 1, wherein a channel is formed in the base and/or in a base-side end of the tank element, wherein the sealing element is inserted in said channel.

3. The collecting tank as claimed in claim 1, wherein the sealing element is a flat seal and/or cord seal with a substantially constant cross section.

4. The collecting tank as claimed in claim 1, wherein at least one stress generating device is provided between the base and a tank element in the fastening region between the at least two adjacent collecting regions and adjacent to the sealing element.

5. The collecting tank as claimed in claim 4, wherein the stress generating device is formed in at least two parts and comprises at least one threaded connection configured to adjust an applied tensile stress.

6. The collecting tank as claimed in claim 4, wherein a part of the stress generating device is fixedly connected to the base or to the tank element and extends through the tank element or through the base in a region of an opening, wherein said part of the stress generating device has a thread at least in one part of an outwardly protruding region, with an element, which is provided with a thread which interacts with said thread, being screwed onto said thread from an outside as a second part of the tensile stress generating device.

7. The collecting tank as claimed in claim 6, wherein the part of the tensile stress generating device which is fixedly connected to the base or to the tank element is formed as a strip and has a plurality of openings in which screws or threaded bolts are fastened so as to be rotationally fixed.

8. The collecting tank as claimed in claim 4, wherein a part, which has an inner thread, of the tensile stress generating device is fixedly connected to the base or to the tank element, and the tank element or the base has an opening through which an element which has an outer thread extends, said element being screwed into the inner thread.

9. The collecting tank as claimed in claim 8, wherein that part of the tensile stress generating device which is fixedly connected to the base or to the tank element is formed as a strip and has a plurality of openings having an inner thread.

10. The collecting tank as claimed in claim 4, wherein the tensile stress generating device includes at least one sealing element.

11. The collecting tank as claimed in claim 10, wherein a sealing arrangement is provided at each side of the tensile stress generating device and/or compressive stress generating means.

12. The collecting tank as claimed in claim 4, wherein the tensile stress generating means and/or compressive stress generating means has at least one clip-type connection.

13. The collecting tank as claimed in claim 4, wherein at least one resilient arm is formed or provided on the tank element or on the base, said resilient arm engaging in an opening in the base or in the tank element.

14. The collecting tank as claimed in claim 13, wherein a plurality of openings is provided, said openings being circular or slot-shaped.

15. The collecting tank as claimed in claim 1, configured to be used as a cooler in a motor vehicle cooling system.

16. A heat exchanger configured to be used as a cooler in a motor vehicle cooling system, the heat exchanger comprising:

tubes; and fins, the tubes communicating with at least one collecting tank as claimed in claim 1.

* * * * *